United States Patent [19]

Hill et al.

[11] Patent Number: 4,979,986

[45] Date of Patent: Dec. 25, 1990

[54] RAPID OXIDATION PROCESS OF CARBONACEOUS AND PYRITIC GOLD-BEARING ORES BY CHLORINATION

[75] Inventors: David L. Hill, Salt Lake City, Utah; Kenneth A. Brunk, Elko, Nev.

[73] Assignee: Newmont Gold Company and Outomec U.S.A., Inc., Englewood, Colo.

[21] Appl. No.: 158,422

[22] Filed: Feb. 22, 1988

[51] Int. Cl.[5] ..... C22B 11/00; C22B 1/00

[52] U.S. Cl. ..... 75/711; 75/717; 75/720; 75/721; 75/722; 75/744; 75/745; 423/29; 423/31; 423/38; 423/39; 423/40; 366/317

[58] Field of Search ..... 423/31, 29, 38, 39, 423/40; 75/1 R, 2, 105, 112, 118 R, 711, 717, 720, 721, 722, 744, 745; 366/317

[56] References Cited

U.S. PATENT DOCUMENTS

| | | | |
|---|---|---|---|
| 2,552,057 | 5/1951 | Paik | 366/317 |
| 2,918,264 | 12/1959 | Ackles | 366/317 |
| 3,290,016 | 12/1966 | Lennon et al. | 366/317 |
| 3,360,460 | 12/1967 | Weston | 366/317 |
| 3,846,124 | 11/1974 | Guay | 75/118 R |
| 3,930,845 | 1/1976 | Bovey et al. | 75/118 R |
| 4,038,362 | 7/1977 | Guay | 423/40 |
| 4,188,362 | 2/1980 | Edwards et al. | 75/112 |
| 4,193,702 | 3/1980 | Davis | 366/317 |
| 4,259,107 | 3/1981 | Guay | 75/118 R |
| 4,289,532 | 9/1981 | Matson et al. | 423/25 |
| 4,353,740 | 10/1982 | Dunn | 75/118 R |
| 4,401,468 | 8/1983 | Henderson | 75/118 R |
| 4,439,235 | 3/1984 | Simpson | 75/118 R |
| 4,444,510 | 4/1984 | Janssen | 366/317 |
| 4,551,213 | 11/1985 | Wilson | 75/118 R |
| 4,578,163 | 3/1986 | Kunter et al. | 75/118 R |
| 4,723,998 | 2/1988 | O'Neil | 75/118 R |

FOREIGN PATENT DOCUMENTS

| | | | |
|---|---|---|---|
| 58-197233 | 11/1983 | Japan | 75/118 R |
| 60-21340 | 2/1985 | Japan | 75/118 R |
| 60-59029 | 4/1985 | Japan | 75/118 R |
| 61-37980 | 2/1986 | Japan | 75/118 R |

OTHER PUBLICATIONS

Brunk et al., "Practical Aspects of Chlorination of Carbonaceous Ores", Process Mineralogy VII, 2-1987, N.J., pp. 1-27.

Seymour et al., "Rapid Oxidation of Refractory Gold-Bearing Ores by Intense Flash Chlorination at Newmont Gold Company", Precious Metals, pp. 165-178, 1986, The Minerals, Metals and Materials Society.

Perry's Chemical Engineering Handbook, 6th Edition, McGraw Hill Co., N.Y., 1984, pp. 19-5-19-11.

*Primary Examiner*—Theodore Morris
*Assistant Examiner*—Paige C. Harvey
*Attorney, Agent, or Firm*—Pennie & Edmonds

[57] ABSTRACT

A method of treating a gold-bearing ore to render the gold component of the ore more amenable to standard cyanidation treatment in a reduced amount of time is disclosed. An aqueous slurry of the gold-bearing ore is introduced into at least one vessel. An oxidizing agent, such as chlorine gas, an alkali metal hypochlorite and an alkaline earth metal hypochlorite, is rapidly introduced into the vessel so that it intimately contacts the aqueous slurry. While the oxidizing agent is being introduced into the vessel, the slurry is agitated with agitating means including a plurality of impeller blades that provide high shear agitation and a large interfacial surface area between the oxidizing agent and the liquid phase of the slurry to enhance the mass transfer of the oxidizing agent so that it becomes substantially completely adsorbed by the aqueous slurry in about 5 to about 15 minutes.

33 Claims, 1 Drawing Sheet

RAPID OXIDATION PROCESS OF CARBONACEOUS AND PYRITIC GOLD-BEARING ORES BY CHLORINATION

BACKGROUND OF THE INVENTION

1. Field of the Invention

This invention relates generally to an improved method for the recovery of gold from carbonaceous and pyritic gold-bearing ores. In particular, the ore is preliminarily treated by subjecting it to rapid oxidation achieved through flash-chlorination to render the gold component of the ore more amenable to standard cyanidation treatment.

2. Description of the Prior Art

Sedimentary gold-bearing ores containing indigenous organic carbonaceous material and gold-bearing pyritic minerals are notoriously refractory to standard cyanidation treatment for the recovery of their gold content. Investigation into the cause of this problem has indicated that the carbonaceous materials comprise active carbon and long-chain organic compounds. The active carbon appears to absorb the gold cyanide complex [$Au(CN)_2$—] from cyanide leaching solutions and the long-chain organic compounds appear to form stable complexes with the gold. In addition, some of these ores also contain gold-bearing sulfides. The sulfides contain gold either as a mechanical inclusion, or as atoms of gold included in the sulfide crystalline lattice.

In order to overcome this sequestering of the gold and to render the gold component of the ore more amenable to standard cyanidation treatment, it has heretofore been proposed that the ore be subjected to a preliminary oxidation treatment to oxidize the carbonaceous, sulfidic mineral materials, and as much of the carbonaceous mineral materials as possible. In experiments conducted by the United States Bureau of Mines, alkaline slurries of carbonaceous gold-bearing ores were subjected to a preliminary oxidation with a wide variety of reagents including ozone, sodium hypochlorite, calcium hypochlorite, permanganates, perchlorates, chlorates and oxygen prior to subjecting the ore to standard cyanidation treatment to extract the gold content therefrom. Of these treatments, the hypochlorites appeared to be the most effective, although it was found that an elevated temperature was required to obtain satisfactory results. At room temperature (about 70° F.) the hypochlorite treatment required several days to make the gold content of the ore available for recovery by cyanidation while temperatures above about 140° F. caused premature decomposition of the hypochlorites. Consequently, it was determined that a temperature within the range of about 122° to 140° F. was required to render the gold component of the ore amenable to standard cyanidation treatment.

U.S. Pat. No. 3,846,124 describes the recoverability, by standard cyanidation, of the gold content of carbon-containing sedimentary gold bearing ores being increased by subjecting the ore to a preliminary oxidation and chlorination treatment in which chlorine gas is introduced into an aqueous slurry of the ground ore having a pH of about 8 to the extent that the slurry will absorb the chlorine, the thus treated slurry being maintained at the chlorination treatment temperature of about 70° to 85° F. for at least 6 hours. The oxidized ore is then subjected to standard cyanidation to extract the gold content therefrom with gold recoveries in the order of 75% or more of the gold content of the ore.

Similarly, U.S. Pat. No. 4,038,362 describes the recoverability, by standard cyanidation, of the gold content of sedimentary gold-bearing ores containing organic carbonaceous material and gold-bearing pyrite, or other gold-bearing sulfides being increased, and the cost of the pretreatment greatly reduced, by subjecting the ore to a two-stage preliminary oxidation and chlorination treatment. In this process, an aqueous slurry of the ore is first heated to about 167° to 212° F. and, thereafter, air or oxygen is introduced into the heated slurry to oxidize and eliminate a substantial portion of the carbonaceous material and oxidizable sulfides in the slurried ore. The slurry is then cooled to about 70° to 85° F., and chlorine gas is introduced into the slurry for a period of 6 to 12 hours and at a pH of 8 or higher to substantially complete the oxidation and chlorination of the carbonaceous and sulfide content of the slurried ore. The oxidized ore is then subjected to conventional cyanidation to recover the gold content therefrom.

Analogously, U.S. Pat. No. 4,259,107 describes a process for treating gold-bearing ores to increase the recovery of gold content therefrom. An aqueous slurry of finely ground ore is first subjected to a preliminary oxidation treatment wherein air or oxygen is bubbled through the slurry while maintaining the slurry at a temperature of from 167° to 212° F. for a period of from 8 to 24 hours. The oxygenated slurry is then cooled to a temperature of from about 70° to 125° F. and acid is added to bring the pH of the slurry down to 6.0 or lower. Chlorine gas or an alkali metal or alkaline earth metal hypochlorite is then added to the slurry until the slurry will no longer absorb or react with these reagents. The thus treated slurry is maintained at a temperature of from 70° to 125° F. for a period of from 6 to 12 hours. The solids content of the slurry is then subjected to standard cyanidation to recover the gold therefrom.

U.S. Pat. No. 4,289,532 describes a process for the recovery of gold from carbonaceous ores. A slurry of carbonaceous gold-bearing ore is oxidized and then subjected to simultaneous cyanidation and granular activated carbon adsorption in two or more solid-liquid extraction stages, where the ore flows countercurrent with the carbon and the gold transfers to the carbon. The chlorination step is carried out at a pH between 5 and 11 or 1 to 6 hours and at a temperature of between 70° and 140° F.

In each of the patents discussed above, it is generally shown that by subjecting a gold-bearing ore to a preliminary chlorination treatment, it is possible to enhance the recovery of gold from such ore during subsequent conventional cyanidation processing.

However, until now, the known methods of chlorination treatment typically involved chlorine gas injections into the slurry or pulp for periods of 1 to 12 hours. Most known techniques involve chlorine gas injections within the upper limits of this range, i.e., between 8 to 12 hours. In addition, the chlorine treatment techniques of the prior art involved the use of large reactors.

The present invention, however, provides a method for the recovery of gold from carbonaceous and pyritic gold-bearing ores and includes an ore pretreatment chlorination step wherein the time required to permit the chlorine gas to become completely adsorbed into the slurry is drastically minimized. In addition, the reactors utilized for the chlorination step are structurally simplified.

SUMMARY OF THE INVENTION

Broadly stated, the present invention relates to a method of treating a gold-bearing ore to render the gold component of the ore more amenable to standard cyanidation treatment in a reduced amount of time. The method of the present invention comprises introducing an aqueous slurry of the gold-bearing ore into at least one vessel; rapidly introducing an oxidizing agent into the at least one vessel so that it intimately contacts the slurry in an amount sufficient to oxidize or deactivate any carbonaceous and sulfidic mineral materials present in the ore; and agitating the slurry in a manner and at a rate sufficient to permit the total amount of oxidizing agent to become substantially completely adsorbed by the aqueous slurry in about 5 to about 15 minutes.

The requisite agitation of the slurry can be achieved by employing agitating means including a plurality of impeller blades that provide high speed agitation and a large interfacial surface area between the oxidizing agent and the liquid phase of the slurry so as to enhance the mass transfer of the oxidizing agent.

Preferably, the oxidizing agent is chlorine gas, but can alternatively be selected from an alkali metal hypochlorite and an alkaline earth metal hypochlorite.

The pH of the slurry is generally maintained between about 2 to about 11. Optionally, the pH of the slurry can be reduced to a range of about 2 to about 6 to increase the rate at which the oxidizing agent will react with the carbonaceous and sulfidic constituents of the ore. The reduction in the pH can be achieved by adding a dilute mineral acid, such as, sulfuric, hydrochloric or nitric, to the slurry before the step of rapidly introducing the oxidizing agent has been performed.

In another embodiment, the method of the present invention further comprises dispersing an oxygen-containing gas through the slurry, prior to the introduction of the chlorine gas, or other oxidizing agent, at a rate and for a time sufficient to allow the oxygen-containing gas to be present in the slurry in an amount in excess of that required for reaction with the carbonaceous compound and gold-bearing sulfides present in the ore.

The present invention relates further to a method of recovering gold from a carbonaceous and pyritic gold-bearing ore which comprises introducing an aqueous slurry of the gold-bearing ore into at least one vessel; rapidly introducing chlorine gas into the at least one vessel in intimate contact with the slurry in an amount sufficient to oxidize or deactivate any carbonaceous and sulfidic mineral materials present in the ore and as the aqueous slurry is maintained at a temperature of about 70° F. to about 125° F.; agitating the slurry in a manner and at a rate sufficient to permit the total amount of chlorine gas to become substantially completely adsorbed by the aqueous slurry in about 5 to about 15 minutes; maintaining the temperature of the aqueous slurry at between about 70° to about 125° F. for at least about 1 hour to allow the reaction mass to equilibrate with resulting passivation or alteration of the carbonaceous content of the ore so that it will not significantly sequester the gold content of the ore; and subjecting the ore to standard cyanidation treatment to recover an amount of gold therefrom.

DESCRIPTION OF EMBODIMENTS

Figure 1:
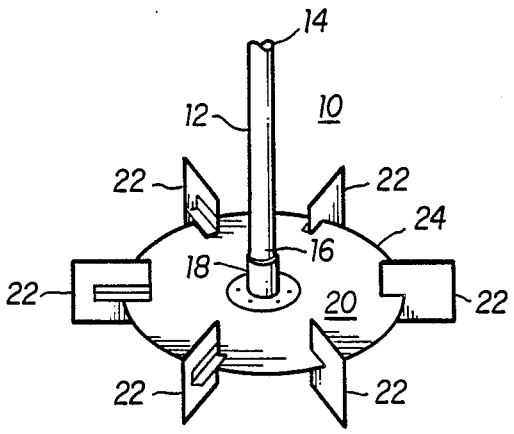
FIG. 1 is a perspective view of an agitator which can be used in accordance with the method of the present invention.

The gold bearing ore contemplated herein typically contains from about 0.06 about 1 or more ounces of gold per ton of ore, from about 0.1 to about 5% by weight of carbon and up to about 5% by weight of pyritic materials.

The ore is prepared for treatment pursuant to the invention by grinding the crushed ore from about 50 to about 70 weight percent minus 200 mesh (Tyler Standard Screen) and pulping the ground ore with a sufficient amount of water so that it will form a slurry with about 40 to about 50% solids in water. The water used in grinding is preferably preheated to about 120° F.

The resulting slurry is heated to a temperature within the range of 167° to 212° F. by conventional means. Optionally, an oxygen-containing gas, such as air or oxygen, is then dispersed through the heated slurry, advantageously by bubbling it into the bottom of the slurry mass by any conventional and appropriate device and at a rate sufficient to permit it to be present in excess of the amount required for the reaction with the carbonaceous compound and gold-bearing sulfides. Generally, this bubbling of the air or oxygen into the slurry will be accompanied by sufficient agitation to insure uniform exposure of the ore to the action of the air or oxygen. The reaction between the oxygen and the carbonaceous component of the ore results in the evolution of carbon dioxide, nitrogen, and excess oxygen from the slurried ore. This reaction between oxygen and the gold-bearing sulfides results in chemical compounds that remain in the slurry. The bubbling is continued for a period of from 8 to 24 hours or until no further oxidation of carbonaceous compounds or gold-bearing sulfides by air or oxygen is being effected.

The slurry is then cooled by conventional means to a temperature within the range of about 70° to about 125° F.

It had been discovered (U.S. Pat. No. 4,259,107) that the recoverability of gold from the ore is enhanced by the addition of acid to the aqueous slurry of the ore to reduce the pH of the slurry within a range of about 2 to about 6 following the optional first oxidation stage and prior to the chlorination stage of the preliminary two stage treatment of the ore. It has further been discovered that the acidification of the slurry permits the chlorination stage of the preliminary treatment of the ore to be carried out at a temperature of from 70° to 125° F., as compared to 70° to 85° F., and that the acidification of the ore slurry significantly increases the rate at which the oxidizing agent, i.e., chlorine gas or sodium hypochlorite, will react with the carbonaceous and sulfide constituents of the ore at temperatures within this range. It is perfectly feasible to use sodium hypochlorite as an alternative to chlorine in the chlorination stage of the present method as further discussed hereinbelow.

It should be perfectly clear, however, that it is preferred and not critical to reduce the pH of the aqueous slurry to about 6 or less. A pH range of between about 2 to about 11 is quite appropriate for purposes of the present invention. Notwithstanding, the pH of the aqueous slurry can be reduced to within the preferred range of about 2 to about 6 by adding an acid to the cooled slurry; the added acid preferably being a dilute mineral acid, such as sulfuric, hydrochloric or nitric acid. The pH of the slurry should not be permitted to fall below about 2, since at a pH below about 2 gold recovery is reduced. This is ascribed to the acid preventing the adsorption of the chlorine gas when the acid is present at a concentration level sufficient to reduce the pH of the slurry to about 2 or lower. Accordingly, the acid should be added to the slurry in an amount sufficient to assure that the resulting pH of the slurry is between the range of about 2 to about 6.

In order to further enhance the amount of gold recovered from the gold-bearing ore, by rendering the gold component more amenable to standard cyanidation treatment, an oxidizing agent, such as chlorine gas, is rapidly dispersed into the slurry at an accelerated rate so that the total chlorine gas injection time is between about 5 minutes to about 15 minutes. Generally, the chlorine gas is continuously introduced into the slurry until the slurry will no longer react with the chlorine gas as evidenced by the presence of a significant amount of chlorine in the gases that typically evolve from the slurry, i.e., carbon dioxide and nitrogen. However, until now, the introduction of chlorine gas into the slurry occurred for at least 1 hour and, most typically, for at least about 8 to 12 hours.

For purposes of this description, the term "rapid" when used, for instance, in the context of a "rapid introduction of chlorine gas into the slurry" or a "rapid dissolution of the chlorine gas into the slurry" or in a context of similar import, is intended to represent a total chlorine gas introduction time of from about 5 to about 15 minutes. The rapid dissolution of chlorine gas into the aqueous slurry can be achieved by agitating the slurry at an agitation rate sufficient to permit the total amount of chlorine gas to be substantially completely absorbed by the aqueous slurry. The attainment of a sufficient agitation rate is dependent upon impeller type, power input and, less significantly, the size of the agitation vessel.

An impeller designed for high-shear application to provide high shear agitation is generally descriptive of the impeller type contemplated herein. The impeller must be capable of creating a large interfacial surface area between the gas and liquid phases to enhance the mass transfer of the chlorine gas.

When being used to agitate the aqueous slurry so that the chlorine gas can be rapidly introduced into the slurry, the agitation means will preferably have a shaft rotation speed of at least about 180 rpm and preferably will have a shaft rotation speed of at least about 190 rpm or greater and a "tip" speed (the rotation speed of the outer edge or "tip" of the impeller) of at least about 1200 ft./min. and, preferably, 1270 ft./min. or greater. The tip speed ($S_t$) can be calculated in accordance with the following equation:

$$S_t = \pi \times (\text{rotational speed (rpm)})$$

where $\times$ is the diameter of the impeller)

The shaft rotation speed and tip speed discussed above provide the proper agitation when the volume of the vessel containing the slurry is about 340 cubic feet. If desired, the practitioner of this invention could use a vessel a larger or smaller volume. In such instances, the appropriate shaft speed to produce the desired tip speed can readily be determined by the equation set forth above and by some minor experimentation.

A Rushton-type flat-blade disk turbine impeller available under the trade name of Mixco R-100 from Mixing Equipment Company, Rochester, New York; and an OK-8 impeller available from OutoKumpu Engineering, Inc., Denver, Colo., are representative of the impellers contemplated herein.

Referring to FIG. 1, illustrated is a means for agitating the aqueous slurry generally designated by reference numeral 10. Agitating means 10 includes a shaft 12, which, on its upper end 14, is rotated by a motor (not shown). The lower end 16 of shaft 12 is engaged by receiving element 18 which is associated with disc 20. Impeller blades 22 are associated with the periphery 24 of disc 20. When the agitating means 10 is at least substantially submerged in the aqueous slurry when contained in a vessel (not shown), a force exerted upon shaft 12 by a motor causes it to rotate in a clockwise or counter clockwise direction causing disc 20 and impeller blades 22 to rotate in the corresponding direction, thereby resulting in an agitation of the aqueous slurry. It is to be understood, however, that the agitation means illustrated in FIG. 1 is provided as an illustration of one type of agitator, and the present invention should not be construed as being limited to the agitator shown in FIG. 1. Furthermore, the power input used to operate the agitation means should be sufficient to enable it to produce the desired shaft rotation speed and tip speed indicated above.

The present method results in gold cyanidation extractions comparable to those known methods, but reduces the amount of time necessary to achieve a total adsorption of chlorine gas and enables the chlorination treatment to occur in a vessel or vessels of reduced size. The reduced size vessel contributes to the attainment of the desired agitation rate.

The chlorination treatment of the ore in accordance with the present invention can occur in a plurality of stages. For instance, the chlorine gas can be introduced into the aqueous slurry in a plurality of serially arranged adsorption vessels. Most preferably, a complete introduction of chlorine gas into the slurry occurs in four stages.

The chlorination of the ore-containing aqueous slurry occurs at a temperature of from about 70° F. to about 125° F., preferably between about 95° F. to about 110° F. and, most preferably, at 104° F., and at a pressure of from about 0 to about 30 psi, preferably between about 10 to about 20 psi and, most preferably, at 15 psi.

The ore may require up to about 150 pounds of chlorine addition to obtain a desirable level of gold cyanidation extraction. The exact amount of chlorine required to achieve the desired extraction level is dependent upon degree of carbonaceous and sulfidic minerals present in the ore, such that the higher the concentration of these materials in the ore, the greater the amount of chlorine that would be required to achieve the desired level of gold cyanidation extraction.

As an alternative to using chlorine gas to oxidize the carbonaceous and sulfidic mineral materials present in the ore, an alkali metal hypochlorite or alkaline earth metal hypochlorite is added to the slurry while the temperature is maintained within the range of 70° to 124° F., the hypochlorite being added to the slurry by any appropriate device and at a rate such that it will be substantially completely adsorbed by the slurry. The adjustment of the pH of the slurry to 6.0 or lower can be made, if desired, either before or after the addition of the hypochlorite to the slurry. As in the case of chlorine gas treatment, there is evolved from the slurry a gas consisting primarily of carbon dioxide and nitrogen, the hypochlorite addition being terminated when the slurry will no longer react with this reagent with consequent buildup of hypochlorite in the slurry. The evidence of the buildup of hypochlorite is advantageously determined by titration of the slurry with sodium thiosulfate solution.

Upon completion of the addition of the chlorine to the slurry, the slurry is held at a temperature within the aforementioned range of about 70° to about 125° F., without further additions of chlorine, for a period of at least about 1 hour, and preferably for a period of between about 6 to about 12 hours while maintaining a sodium hypochlorite concentration of about 1.0 gpl. The sodium hypochlorite concentration of the pulp is reduced to this trace level by the addition of a reducing agent or by further agitation without the addition of chlorine gas. During this period, the reaction mass equilibrates with resulting passivation or alteration of the carbonaceous content of the ore so that it will not significantly sequester the gold content of the ore when the thus-treated ore is subsequently subjected to standard cyanidation. Where the ambient temperature during this holding period drops below the aforementioned range of about 70° to about 125° F., heat is added to the reaction mass by any conventional means in order to hold the temperature of the mass within the stated range.

The following example is presented to provide a further illustration of the present invention and is not intended to be limiting in any way.

EXAMPLES 1–4

A series of tests were conducted. In each of the tests, a refractory carbonaceous gold-bearing ore was ground to about 60% minus 200 mesh. The ground material was pulped in a 4000 ml beaker and adjusted, by weight, to about 40% solids. The beaker was placed in a water bath and the pulp temperature elevated to 40° C., and then maintained. Four ¾ wide baffles were placed in the beaker (90° apart) and the impeller inserted into the pulp. Attached to one of the baffles was a glass tube, through which chlorine gas was injected at the bottom of the beaker, just below the impeller. A 6 inch blade "Rushton" type impeller (Mixco R100) was utilized for pulp agitation and gas dispersion.

The chlorine gas was injected into the pulp at a rate in which most of the chlorine gas was added over 5 to 15 minutes. This pulp is then agitated for 1 to 4 hours maintaining about 1.0 g/l sodium hypochlorite. The exact times required for most of the chlorine gas to be injected, as well as the exact time of additional agitation, where applicable, are indicated below in Table I.

At the end of chlorination (flash chlorination plus additional retention time), the sodium hypochlorite concentration was reduced to a trace level by the addition of a reducing agent (NaHS and/or $HaHSO_3$) or further agitation without the addition of chlorine gas. The resulting pulp was then subjected to conventional cyanidation practices. The test results appear below in Table I.

In Examples 1, 1a, 2 and 2a the ore contained 0.158 oz. of gold per ton of ore, 0.6% of organic carbon and 0.4% of total sulfur. In Examples 3, 3a and 3b, the ore contained 0.303 oz. gold per tone of ore, 1.4% of organic carbon and 1.0% of total sulfur.

TABLE I

| Example No. | Chlorine Gas Injection Time (Minutes) | Additional Agitation Time (Minutes) | Cyanidation Gold Extraction |
|---|---|---|---|
| 1 | 5 | 0 | 70.6% |
| 1a | 5 | 180 | 83.9% |
| 2 | 15 | 0 | 73.2% |
| 2a | 15 | 240 | 86.3% |
| 3 | 15 | 0 | 65.0% |
| 3a | 15 | 60 | 79.5% |
| 3b | 15 | 120 | 86.8% |

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A method of treating a gold-bearing ore to render the gold bearing portion of the ore more amenable to standard cyanidation treatment which comprises:

introducing a slurry of the gold-bearing ore into at least one vessel;

introducing an oxidizing agent into the at least one vessel so that it intimately contacts the slurry in an amount sufficient to oxidize or deactivate any carbonaceous and sulfidic mineral materials present in the ore; and agitating the slurry in a manner sufficient to permit the total amount of oxidizing agent to become substantially completely adsorbed by the aqueous slurry in about 5 to about 15 minutes.

2. The method of claim 1 wherein the oxidizing agent is chlorine gas.

3. The method of claim 1 wherein the oxidizing agent is selected from the group consisting of an alkali metal hypochlorite and an alkaline earth metal hypochlorite.

4. The method of claim 2 wherein the chlorine gas is introduced into the vessel as the aqueous slurry is maintained at temperature of about 70° F. to about 125° F.

5. The method of claim 2 wherein the chlorine gas is introduced into the vessel as the slurry is maintained at a temperature of about 95° F. to about 110° F.

6. The method of claim 2 wherein the chlorine gas is introduced into the vessel as the slurry is maintained at a temperature of about 104° F.

7. The method of claim 1 wherein the slurry is agitated with agitating means including a plurality of impeller Plades that promote contact between the oxidizing agent and the liquid phase of the slurry so as to enhance the mass transfer of the oxidizing agent.

8. The method of claim 7 wherein the agitating means further include a shaft having a potential rotation speed of 190 rpm and wherein the impeller blades, when rotated, have a tip speed of 1270 ft./min.

9. The method of claim 1 wherein the slurry has a pH of about 2 to about 11.

10. The method of claim 9 which further comprises adding an acid to the aqueous slurry to reduce the pH of the slurry within a range of about 2 to about 6, prior to introducing the oxidizing agent into the vessel, to increase the rate at which the oxidizing agent will react with the carbonaceous and sulfidic constituents of the ore.

11. The method of claim 10 wherein the acid is a mineral acid.

12. The method of claim 11 wherein the mineral acid includes sulfuric, hydrochloric or nitric acid.

13. The method of claim 1 which further comprises dispersing an oxygen-containing gas through the slurry, prior to introducing the oxidizing agent into the slurry, to provide an amount in excess of that required for reaction with the carbonaceous and sulfidic constituents of the ore.

14. The method of claim 13 wherein the oxygen-containing gas includes oxygen or air.

15. The method of claim 1 wherein the slurry and the oxidizing agent are introduced into a plurality of vessels.

16. The method of claim 15 wherein the slurry and the oxidizing agent are introduced into four vessels.

17. The method of claim 1 wherein the ore contains from about 0.06 to about 1 or more ounces of gold per ton of ore, from about 0.1 to about 5% by weight of carbon and up to about 5% by weight of pyritic materials.

18. The method of claim 1 wherein the slurry is prepared by grinding the ore from about 50 to about 70 weight percent minus 200 mesh and pulping the ground ore with a sufficient amount of water to form an aqueous slurry with about 40 to about 50% solids in water.

19. A method of treating a gold-bearing ore to render the gold bearing portion of the ore more amenable to standard cyanidation treatment which comprises:

grinding the gold-bearing ore to about 50 to about 70 weight percent minus 200 mesh;

pulping the ground ore with an amount of water to form a slurry with about 40 to about 50% solids in water;

introducing the slurry of the gold-bearing ore into at least one vessel;

dispersing an oxygen-containing gas through the aqueous slurry to provide in an amount which exceeds that required for reaction with the carbonaceous and sulfidic constituents of the ore;

introducing chlorine gas into said at least one vessel so that it intimately contacts the slurry in an amount sufficient to oxidize or deactivate any residual carbonaceous and sulfidic constituents present in the ore; and agitating the slurry with agitating means including a plurality of impeller blades that promotes contact area between the chlorine gas and the liquid phase of the slurry to increased the mass transfer of the chlorine gas so that the total amount of chlorine gas becomes substantially completely adsorbed by the slurry in about 5 to about 15 minutes.

20. The method of claim 19 wherein the chlorine gas is introduced into the vessel as the slurry is maintained at a temperature of about 70° F. to about 125° F.

21. A method of recovering gold from a carbonaceous and pyritic gold-bearing ore which comprises:

introducing a slurry of the gold-bearing ore into at least one vessel;

introducing chlorine gas into the at least one vessel in intimate contact with the slurry and in an amount sufficient to oxidize or deactivate any carbonaceous and sulfidic mineral materials present in the ore and as the slurry is maintained at a temperature of about 70° F. to about 125° F.;

agitating the slurry in a manner sufficient to permit the total amount of chlorine gas to become substantially completely adsorbed by the slurry in about 5 to about 15 minutes;

maintaining the temperature of the slurry at between about 70° F. to about 125° F. for at least about 4 hours to allow the reaction mass to equilibrate with resulting passivation or alteration of the carbonaceous and sulfidic content of the ore so that it will not significantly sequester the gold content of the ore; and subjecting the ore to standard cyanidation treatment to recover an amount of gold therefrom.

22. The method of claim 21 wherein the slurry is agitated, with agitating means including a plurality of impeller blades that promotes contact between the chlorine gas and the liquid phase of the slurry so as to increase the mass transfer of the chlorine gas.

23. The method of claim 21 wherein slurry has a pH of about 2 to about 11.

24. The method of claim 23 which further comprises adding an acid to the slurry to reduce the pH of the slurry to within a range of about 2 to about 6 prior to introducing the chlorine gas into the vessel, to increase the rate at which the chlorine gas will react with the carbonaceous and pyritic constituents of the ore.

25. The method of claim 24 wherein the acid is a mineral acid.

26. The method of claim 25 wherein the mineral acid includes sulfuric, hydrochloric or nitric acid.

27. The method of claim 21 which further comprises dispersing an oxygen-containing gas through the slurry, prior to introducing the chlorine gas into the slurry, to provide an amount that exceeds that required for reaction with the carbonaceous and sulfidic constituents of the ore.

28. The method of claim 27 wherein the oxygen-containing gas is oxygen.

29. The method of claim 27 wherein the oxygen-containing gas is air.

30. The method of claim 21 wherein the slurry and the chlorine gas are introduced into a plurality of vessels.

31. The method of claim 30 wherein the slurry and the chlorine gas are introduced into four vessels.

32. The method of claim 21 wherein the ore contains from about 0.06 to about 1 or more ounces of gold per ton of ore, from about 0.1 to about 5% by weight of carbon and up to about 5% by weight of pyritic materials.

33. The method of claim 21 wherein the slurry is prepared by grinding the ore from about 50 to about 70 weight percent minus 200 mesh the ground ore with amount of water to form a slurry with about 40 to about 50% solids in water.

* * * * *